United States Patent [19]

Rivera

[11] Patent Number: 4,932,512

[45] Date of Patent: Jun. 12, 1990

[54] ESCALATOR HANDRAIL GUIDE RAIL MOUNTING ASSEMBLY

[75] Inventor: James A. Rivera, Bristol, Conn.

[73] Assignee: Otis Elevator Company, Farmington, Conn.

[21] Appl. No.: 420,435

[22] Filed: Oct. 12, 1989

[51] Int. Cl.[5] ..... B66B 23/24

[52] U.S. Cl. ..... 198/337; 198/335

[58] Field of Search ..... 198/335, 337; 52/184, 52/393, 399–403, 716, 717.1, 718.1, 823, 824, 601, 307, 308, 476, 656, 397, 398, 813, 821; 256/24, 68, 70; 248/74.2, 222.1

[56] References Cited

U.S. PATENT DOCUMENTS

| | | | |
|---|---|---|---|
| 2,028,358 | 1/1936 | Shonnard | 198/337 |
| 2,058,379 | 10/1936 | Handy et al. | 198/335 |
| 2,617,159 | 11/1952 | Leighton | 52/398 |
| 2,840,869 | 7/1958 | Fegan | 52/400 X |
| 2,934,800 | 5/1960 | Hasbrouck et al. | 52/398 X |
| 3,081,504 | 3/1963 | Bohnsack | 52/400 |
| 3,099,337 | 7/1963 | Hetman | 52/400 |
| 3,321,059 | 5/1967 | Kroepel | 198/335 |
| 3,363,390 | 1/1968 | Crane et al. | 52/823 X |
| 3,623,590 | 11/1971 | Johnson | 198/337 |
| 3,981,118 | 9/1976 | Johnson et al. | 198/335 X |
| 3,989,133 | 11/1976 | Courson et al. | 198/335 |
| 3,991,877 | 11/1976 | Kraft et al. | 198/335 |
| 4,488,631 | 12/1984 | Courson | 198/335 |
| 4,658,946 | 4/1987 | Adrian et al. | 198/337 |
| 4,666,028 | 5/1987 | Saito et al. | 52/718.1 X |
| 4,703,598 | 11/1987 | Wilson et al. | 52/397 X |
| 4,836,353 | 6/1989 | Adrian et al. | 198/335 |

FOREIGN PATENT DOCUMENTS

| | | | |
|---|---|---|---|
| 1512084 | 2/1968 | France | 198/335 |
| 2104471 | 3/1983 | United Kingdom . | |
| 2143194 | 2/1985 | United Kingdom . | |
| 2152002 | 7/1985 | United Kingdom . | |

*Primary Examiner*—Robert J. Spar
*Assistant Examiner*—D. Glenn Dayoan
*Attorney, Agent, or Firm*—William W. Jones

[57] ABSTRACT

The handrail guide rail has a base part which is preferably extruded metal, and can be rectilinear or curvilinear. The base telescopes over the top of the escalator balustrade which is a relatively thin glass or metal component of the escalator. Spring clamps are trapped between the balustrade and the guide rail base to clamp the base onto the balustrade.

4 Claims, 1 Drawing Sheet

ESCALATOR HANDRAIL GUIDE RAIL MOUNTING ASSEMBLY

TECHNICAL FIELD

This invention relates to an assembly for attaching an escalator handrail guide rail to an escalator balustrade, and to a guide rail incorporating such an attachment assembly. The assembly of this invention may be used in conjunction with the handrail guide disclosed in co-pending U.S.S.N. 386,314, filed July 28, 1989.

BACKGROUND ART

Newer more modern escalators frequently include thin transparent, or non-transparent, balustrades which may be made of glass or some other material. Such balustrades are used to increase the aesthetic appeal of the escalator assembly. These balustrades are typically substantially thinner than the width of the handrails which move over them, whereby suitable laterally enlarged guide rails must be mounted on the balustrade to support the handrails. Typical examples of such balustrade assemblies are shown in U.S. Pat. Nos. 2,028,358 granted Jan. 21, 1936 to H. W. Shonnard; 3,321,059 granted May 23, 1967 to C. J. Kroepel; 3,981,118 granted Sept. 21, 1976 to E. D. Johnson, et al.; 3,989,133 granted Nov. 2, 1976 to I. C. Courson, et al.; 3,991,877 granted Nov. 16, 1976 to J. K. Kraft, et al.; 4,488,631 granted Dec. 18, 1984 to I. C. Courson; 4,658,946 granted Apr. 21, 1987 to W. Adrian, et al.; 4,705,155 granted Nov. 10, 1987 to O. Kanamori; French Patent No. 1,512,084 dated Feb. 21, 1967 to Otis Elevator Company; and British patent applications Nos. 2,104,471 to Hitachi Ltd. published Mar. 9, 1983; 2,143,194 to O&K published Feb. 6, 1985; and 2,152,002 to Mitsubishi Denki Kabushiki Kaisha, published July 31, 1985. One problem manifesting itself with such handrail-balustrade assemblies relates to dissipation of heat created by frictional drag between the handrail and the handrail guide over which the handrail slides. The frictional drag heat problem is particularly noted in a curved escalator such as is shown in U.S. Pat. No. 4,809,840 granted Mar. 7, 1989 to H. Nakatani wherein the handrail is pulled laterally inwardly toward the center of its path of travel, as well as being pulled along its arcuate path of travel. Another problem which arises in connection with the aforesaid curved escalators relates to forming a handrail guide rail with a lateral curvilinear shape. It will be appreciated that many of the guide rails shown in the prior art are not amenable to being formed with a lateral or transversely curved configuration. The guide rail disclosed is Adrian, et al. U.S. Pat. No. 4,836,353 can be simply clamped onto the thin balustrades without the need for extraneous bolts, nuts, clamp or the like, and without the need to penetrate the balustrade. This guide rail cannot, however, be formed with a transverse curvature.

DISCLOSURE OF THE INVENTION

This invention relates to an escalator handrail guide rail and a mount assembly therefor which can be clamped onto a thin balustrade without bolts, nuts, or the need to penetrate the balustrade, and which guide rail and mount assembly can be formed with a transverse curvature so as to be usable on a curved escalator. The mount assembly includes a base part which may be formed from an extruded material, such as metal or plastic, or which can be machined from stock, or otherwise formed. The base has a channel formed in its undersurface into which the top of the balustrade telescopes. Recessed pockets are formed on the sides of the channel for the reception of spring clips. The spring clips are mounted on the balustrade at spaced locations thereon and the guide rail base is then pressed down onto the balustrade over the spring clips. The spring clips are thus stressed between the balustrade and guide rail base whereby a clamping action between the guide rail base and the balustrade is created by the stressed spring clips. The mass of the guide rail base can be such that heat created by the handrail sliding along the guide rail track will be conducted away from the handrail by the guide rail base.

It is therefore an object of this invention to provide an escalator handrail guide rail assembly which can be mounted on an escalator balustrade without the need for bolts, nuts, or the need to penetrate the balustrade.

It is a further object of this invention to provide a guide rail assembly of the character described which can be formed with a lateral or transverse curvature for use on a curved escalator.

It is another object of this invention to provide a guide rail assembly of the character described which can conduct heat away from the handrail.

These and other objects and advantages of the invention will become more readily apparent from the following detailed description of a preferred embodiment thereof when taken in conjunction with the accompanying drawings, in which:

BEST MODE FOR CARRYING OUT THE INVENTION

Figure 2:
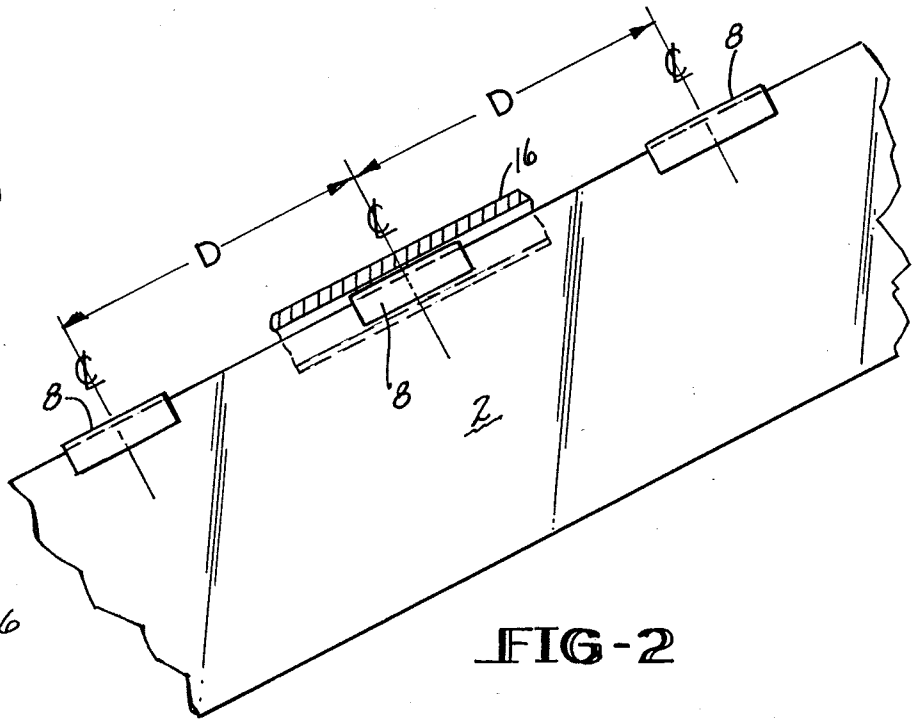
FIG. 2 is a fragmented side elevational view of an escalator balustrade showing how the spring clips are spaced along the balustrade.
Figure 1:
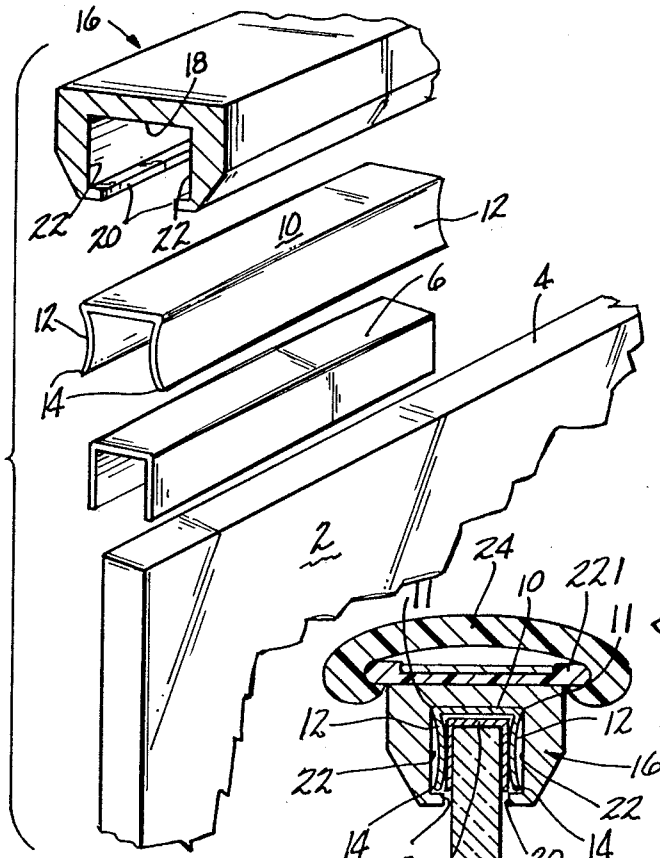
FIG. 1 is an exploded fragmented perspective view of the handrail guide rail mounting assembly of this invention.

Referring now to the drawings, the escalator balustrade 2 is a relatively thin sheet of glass, metal, or the like which flanks the escalator treadway (not shown) in a conventional manner. On the top edge 4 of the balustrade 2 a paper gasket 6 is mounted. The gasket 6 covers the top 4 of the balustrade 2 and also extends down over the sides of the balustrade 2 to protect the latter against scratching, and to increase the frictional grip between the balustrade 2 and the guide rail mount. A spring clamp 8 overlies the gasket 6. The clamp 8 is made from steel and includes a top wall 10 and downwardly depending legs 12. The legs 12 are inwardly curved whereby a medial clamping action is established between the clamp 8 and the balustrade 2 and gasket 6. The lower free edges 14 of the clamp legs 12 are spaced outwardly from the balustrade 2. The guide rail base 16 may be formed from extruded aluminum and can be extruded with a transverse curvilinear configuration. A channel 18 is formed in the underside of the base 16. Flanges 20 are formed at the mouth of the channel 18 to provide pockets 22 on the sides of the channel 18.

As shown in FIG. 2, the clamps 8 will be spaced apart along the balustrade 2. Spacing between the center lines of adjacent clamps 8 will typically be between 200 and 300 mm. The base 16 on the other hand is continuous to the extent that it extends over and is held in place on the balustrade 2 by a plurality of the clamps 8.

Figure 3:
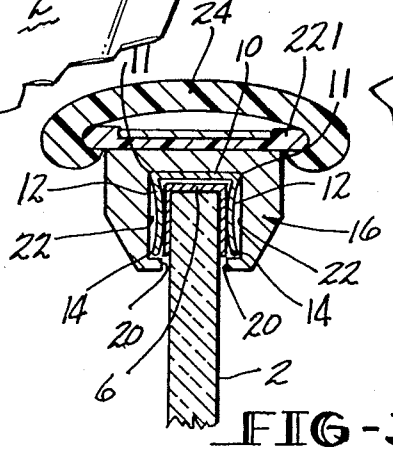
FIG. 3 is a transverse sectional view of the assembled balustrade, guide rail mounting assembly, guide rail track and handrail.

FIG. 3 shows the balustrade, mount assembly, guide rail track and handrail in cross section as assembled. The lower edges 14 of the clamp legs 12 are caught in the base channel pockets 22, and press against the sides of the channel pockets 22. This causes the legs 12 to deflect inwardly from the corners 11 of the top wall 10 of the clamp 8, whereby the curved medial portions of the legs 12 clamp against the gasket 6 and underlying balustrade 2. The legs 12 also have their lower edges 14 stressed or clamped against the sidewalls of the channel pockets 22 adjacent the flanges 20. The guide rail track 221 over which the handrail 24 slides is fastened to the top surface of the base 16.

It will be readily appreciated that the mounting assembly of this invention is quickly and easily secured to the balustrade. A clamping force of 20 lbs per linear inch can be generated by the spring clamp whereby the handrail and guide rail assembly is securely held in place. The assembly is versatile in that it can assume a rectilinear or curvilinear configuration. The mass of the mount base can be such that it can be useful in conducting heat caused by sliding friction away from the handrail whereby the latter will not become uncomfortably warm to the touch. Since many changes and variations of the disclosed embodiment of the invention may be made without departing from the inventive concept, it is not intended to limit the invention otherwise than as required by the appended claims.

What is claimed is:

1. A mounting assembly for securing an escalator handrail guide rail to an escalator balustrade, said assembly comprising:

(a) a guide rail base member for positioning atop the balustrade, said base member being formed with a downwardly open channel operable to receive a top edge of the balustrade, opposed side walls of said channel being formed by rigid, non-deflectable legs on said base member; and (b) U-shaped metal spring means sized for disposing in said channel, said spring means having opposed side portions thereof which are arcuately inwardly curvilinear for interposition between sides of the balustrade and said side walls of said channel, said spring means side portions being operable to provide line clamping contact of said base member to the balustrade by deforming and stressing when said base member is mounted on the balustrade with said spring means in place in said channel.

2. The mounting assembly of claim 1 wherein said base member is provided with converging flanges at a mouth of said channel, said flanges being operable to form pockets at said channel side walls for receiving said spring means.

3. The mounting assembly of claim 1 wherein said base member is an extruded metallic member of sufficient cross-sectional area to be operable to conduct heat generated by the handrail sliding over the guide rail away from the handrail toward the balustrade.

4. A mounting assembly for securing an escalator handrail guide rail to an escalator balustrade, said assembly comprising:

(a) a base member formed from extruded metal, said base member having sufficient cross-sectional area to effectively conduct heat away from the handrail, said base member being formed with a channel extending along its length and having an open mouth for receiving the balustrade, said base member having a pair of flanges facing said open mouth to form side pockets in said channel adjacent sides of the balustrade when the latter is disposed in said channel; and a U-shaped spring clamp for seating in said channel, said spring clamp having inwardly medially curved spring legs operable to engage said channel pockets and to form a line clamping engagement with the sides of the balustrade to firmly secure the balustrade and base member together.

* * * * *

UNITED STATES PATENT AND TRADEMARK OFFICE

CERTIFICATE OF CORRECTION

PATENT NO. : 4,932,512

DATED : June 12, 1990

INVENTOR(S) : James A. Rivera

It is certified that error appears in the above-identified patent and that said Letters Patent is hereby corrected as shown below:

Col. 1, line 52, "Adrian, et al. U.S. Pat. No. 4,836,353" should read --U.S. Patent No. 4,836,353 to Adrian, et al.--.

In Claim 4, Col. 4, line 36, "a" should read -- b)--.

Signed and Sealed this

Twenty-first Day of January, 1992

*Attest:*

HARRY F. MANBECK, JR.

*Attesting Officer*

*Commissioner of Patents and Trademarks*